United States Patent [19]

Reider

[11] Patent Number: 4,474,366

[45] Date of Patent: Oct. 2, 1984

[54] ARTICLE STACKING MACHINE

[75] Inventor: Donald F. Reider, Philadelphia, Pa.

[73] Assignee: Avery International Corporation, Pasadena, Calif.

[21] Appl. No.: 455,463

[22] Filed: Jan. 3, 1983

[51] Int. Cl.[3] ..... B65H 29/46

[52] U.S. Cl. ..... 271/181; 271/220

[58] Field of Search ..... 271/180, 181, 177, 220, 271/221, 223

[56] References Cited

U.S. PATENT DOCUMENTS

| | | | |
|---|---|---|---|
| 3,182,821 | 5/1965 | Parker | 271/181 X |
| 3,188,945 | 6/1965 | Renauer | 271/181 X |
| 4,068,839 | 1/1978 | Bullock | 271/220 X |
| 4,172,531 | 10/1979 | Müller | 271/181 X |

*Primary Examiner*—Richard A. Schacher

*Attorney, Agent, or Firm*—Christie, Parker & Hale

[57] ABSTRACT

A stacking machine stacks sheet-like articles such as tickets, labels, cards, etc. A pair of transport belts move the articles to a stacking area in front of a pair of continuously reciprocating pusher plates. One or more pusher feet on each pusher plate apply a pushing force to each article for pushing it onto a stack that accumulates in the stacking area. The pusher feet are pivotally secured to the pusher plates so they can freely rotate between an operative position and an inoperative position. The articles are fed to the pusher plates by pressure rollers for applying an upward force to the articles to move them in series into a stacking position. Any contact between the pusher feet and the articles being moved by the pressure rollers will move the pusher feet into the inoperative position in which they are disabled from applying a pushing force, even during the forwardmost stroke of the pusher plates. When the article is released to the stacking position by the pressure rollers, and the pusher feet have automatically rotated under their own weight to the operative position during a return stroke of the pusher plates, the operative pusher feet can then push the article onto the stack during the next forward stroke of the pusher plates. Spring-biased gates on opposite sides of the pusher plates act as a stop to prevent each article from springing back into the pusher area and blocking the entrance of the forthcoming articles.

12 Claims, 13 Drawing Figures

ARTICLE STACKING MACHINE

FIELD OF THE INVENTION

This invention relates to a machine for stacking flexible sheet-like articles such as tickets, labels, cards, etc.; and more particularly to a high speed stacking machine that can stack such articles on edge as they are fed in series from a high speed printing press, for example.

BACKGROUND OF THE INVENTION

There is a need to stack individual printed sheet-like articles such as tickets, labels, cards and the like after they are fed from a printer. For instance, a label printing machine can print labels and cut them into individual labels which are then dispensed in series from the printer at speeds up to about 240 labels per minute. It is desirable to stack such printed articles continuously so that the printer need not be stopped or delayed during its high speed printing operation.

It is also often desirable to stack printed articles of varying length. For instance, a computer-controlled machine for printing tickets may print groups of tickets in different formats and separate the groups by flag cards which are longer than the tickets being printed. There is a need for a stacking machine that can stack such tickets on-end with the groups of tickets being separated by the longer flag cards, without the different lengths of tickets and flag cards interfering with the continuous stacking operation or delaying the printer.

A stacking machine also should be able to stack articles at high speed independently of any random spacing between the articles fed in series to the stacking machine from a printer or the like.

Moreover, a stacking machine that operates at high speed must be able to push articles onto a stack and prevent the stacked articles from backing up and interferring with the continuous operation of the stacking machine. A high speed stacking machine must be especially reliable in stacking flexible articles such as tickets which can be prone to buckling, bending, or possibly snagging the stacking mechanism.

The present invention solves these problems by providing a high speed stacking machine that continuously stacks individual articles fed in series to the stacker, independently of variations in the length of the stacked articles and independently of any random spacing between the articles being fed to the stacker. The stacking machine also stacks articles rapidly while preventing the stacked articles or bendable articles from interferring with the rapid cycling of the stacker.

SUMMARY OF THE INVENTION

Briefly, this invention provides a stacking machine having a pusher mechanism comprising a pusher plate and a movable pusher foot on a working end of the pusher plate. The pusher plate reciprocates in forward and reverse directions toward and away from a stacking area adjacent the working end of the pusher plate. A transport mechanism feeds sheet-like articles to a stacking position at the stacking area. The articles are released by the transport mechanism once the articles have moved to the stacking position. The foot on the pusher plate is movable between (1) an operative position in which the pusher foot can apply a positive pushing force to an article released to the stacking position as the pusher plate moves in the forward direction, and (2) an inoperative position to which the pusher foot can move in response to contact with an article still being fed into the stacking position by the transport mechanism. A positive pushing force is not applied to the article by the inoperative pusher foot as long as the article is still being fed into the stacking position.

The articles are fed continuously to the stacking position in series; and each article, independently of its length or the spacing between articles, is positively moved to the stacking position. Any contact with the pusher foot does not affect the article while it moves to the stacking position, since contact with the moving article will move the pusher foot into the inoperative position. Once the article is released into the stacking position, it will be pushed forward on the next forward stroke of the pusher plate. The pusher foot will remain in the operative position for applying a positive pushing force to the article to push it onto a stack at the end of the stacker.

In one embodiment of the invention, the stacking area is kept open for entering articles by a gate mechanism which prevents previously stacked articles from moving back toward the reciprocating pusher plate. The gate mechanism can be in the form of retaining latches that are opened by an article which is pushed past them. The pusher foot, on its forward stroke, pushes the articles past the retaining latches which immediately spring to a closed position during the return stroke of the pusher plate to act as a stop for preventing the stacked articles from moving back toward the stacking position. The pusher foot is preferably an elongated bar for contacting each article (independent of the length of the article) over most of the length of the article when pushing the article through the retaining latches. This ensures that each article will lay flat and be pushed squarely out of the latches. A positive feeding mechanism for transporting the article to the stacking position ensures that each article (independent of the length of the article) is not pushed forward by the stacker until the article is entirely transported to the stacking postion and released by the feeding mechanism.

These and other aspects of the invention will be more fully understood by referring to the following detailed description and the accompanying drawings.

DRAWINGS

DETAILED DESCRIPTION

Figures 1, 2:
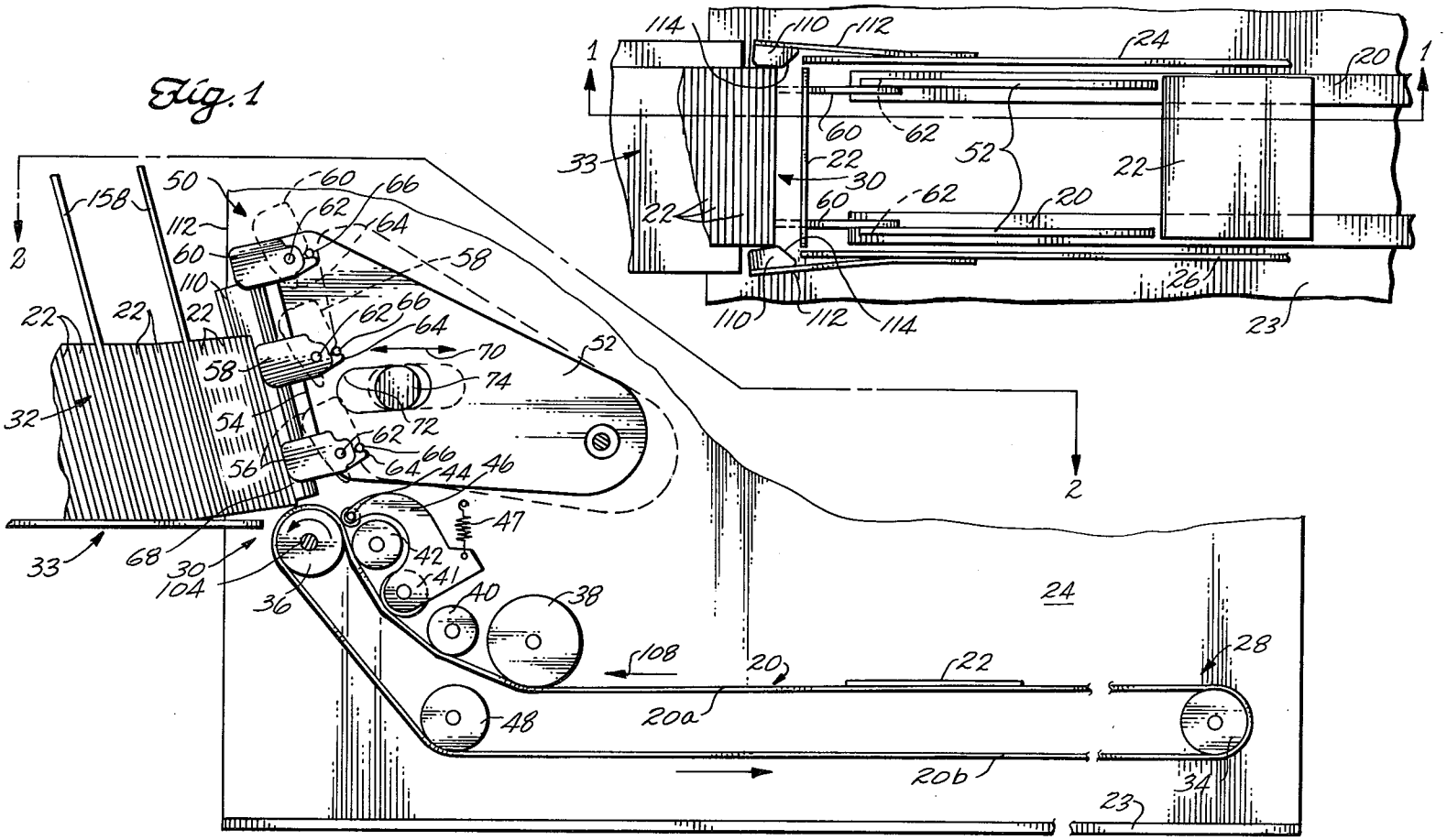
FIG. 1 is a fragmentary, semi-schematic side elevation view, taken on line 1—1 of FIG. 2, illustrating components of a article stacking machine according to principles of this invention.
FIG. 2 is a fragmentary, top plan view taken on line 2—2 of FIG. 1.

FIGS. 1 and 2 are side elevation and top plan views semi-schematically illustrating components of an article stacking machine according to principles of this invention. The stacking machine includes a pair of spaced apart, parallel, endless transport belts 20 which carry a series of spaced apart individual sheet-like articles to be stacked. The illustrated embodiment will be described in the context of stacking individual tickets 22 which are cut and ejected in series from a printing machine (not shown). Alternatively, the stacking machine can be used to stack other sheet-like articles such as labels, cards, etc. The tickets fed from the printing machine are automatically placed in series on a front end (the right end in FIG. 1) of the track formed by the two parallel transport belts 20.

The transport belts are mounted on rollers affixed to the inside faces of a pair of spaced apart, parallel, elongated guide walls extending along the outside of the track formed by the transport belts. The two guide walls are mounted on a flat base 23. The two walls comprise a fixed upright inboard stacker guide wall 24 and an upright outer stacker guide wall 26. The track formed by the transport belts extends lengthwise from a ticket receiving region 28 at the front end of the track to a stacking area 30 at the opposite end of the track. A stack 32 of the tickets 22 is shown being formed at the stacking area. The stack of tickets accumulates on a stacker output tray 33 described in more detail below.

Each transport belt passes around a separate idler roller 34 near the front end of the track and a separate belt drive roller 36 at the opposite end of the track near the stacking region 30. This forms an upper forward run 20*a* of the transport belt and a lower reverse run 20*b* of the transport belt. The front portion of the upper run 20*a* extends horizontally for approximately three-fourths the length of the track. The upper run, for approximately the last quarter of the track length, then passes upwardly and outwardly at about a 45° angle before passing over the belt drive roller 36. A large pinch roller 38 contacts the upper run 20*a* of the transport belt at the point where the belt begins its angular ascent. A series of three medium-diameter pinch rollers 40, 41, 42 in upwardly ascending order contact the upper run of the belt during its ascent. A small-diameter pinch roller 44 contacts the upper run of the belt and applies pressure to the belt on a side opposite the belt drive roller 36. The small pinch roller is mounted on a spring-loaded carriage comprising a pair of side plates 46 mounted to rotate about the axis of the roller 41. The side plates support the small roller 46, and springs 47 bias the small roller toward the transport belts. A roller 48 below the roller 40 contacts the lower run 20*b* of each transport belt after the lower run descends angularly from the drive roller 36. The roller 48 contacts the lower run of the belt so that approximately the remaining three-fourths of the length of the lower run is horizontal and parallel to the horizontal upper run of the belt.

FIGS. 1 and 2 show the tickets 22 travelling along the horizontal upper run 20*a* of the transport belts. After reaching the ascending portion of the upper run, the pinch rollers 38, 40, 41, 42, and 44 transport the ticket uphill and push the ticket under a positive upward force into the stacking region 30 in front of a reciprocating pusher mechanism 50. The pinch rollers finally release the ticket, after which the pusher mechanism 50 pushes the ticket forward onto the stack 32. The spring-biased roller 44 applies a downward pressure on each ticket which assists in feeding the ticket upwardly into the stacking area so that the face of the ticket is squared with respect to the reciprocating pusher mechanism.

The stacking mechanism 50 includes a pair of spaced apart, parallel pusher plates 52 each of which is positioned above the end portion of a corresponding transport belt. The length of each pusher plate extends parallel to the length of its corresponding transport belt. Each pusher plate is generally triangular in shape with a leading edge 54 at the working end of the pusher plates adjacent the stacking area 30. Each pusher plate tapers narrower away from the leading edge to a narrower rear portion which is connected to a reciprocating drive described below.

One or more pusher feet are rotatably affixed to the working end of each pusher plate. The pusher feet push the articles onto the stack when each article is ready to be pushed forward. While the article is being fed to the stacking area, the pusher feet are rotated to an inoperative position to prevent them from applying a pushing force to the articles. The pusher foot can be in various forms. In the embodiment illustrated in FIGS. 1 through 10, a series of vertically spaced apart pusher feet are affixed to the front end portion of each pusher plate. The pusher feet project away from the leading edge of the pusher plate toward the stacking area in front of the reciprocating pusher mechanism. The number of pusher feet can vary; and in the illustrated embodiment each pusher plate has three pusher feet illustrated in the drawings as a lower foot 56, an intermediate foot 58, and an upper foot 60. Separate pivot pins 62 pivot each of the pusher feet to the pusher plate. Each foot is free to pivot about the pin 62 between an operative position (shown in solid lines in FIG. 1) and an inoperative position (shown in dotted lines in FIG. 1). Each foot is normally retained in the operative position which is an at-rest position in which the feet project away from the front edge 54 of the pusher plate (generally normal to the front edge 54) toward the stacking area 30. The rear portion of each foot has a projecting finger 64 which extends below a corresponding stop pin 66 carried on the pusher plate. Each foot normally can rotate downward (counterclockwise in FIG. 1) under gravity about the pivot pin 62 until the finger at the rear of each foot engages the stop pin. This contact with the stop pin releasably retains each foot in the operative position. Each foot is free to pivot upwardly (clockwise in FIG. 1) to an inoperative position out of contact with the stop pins under an upward force applied to the lower front corner 68 of each foot. When the force is released, each foot will normally fall under gravity into the operative position, retained by the stop pin.

Figure 12:
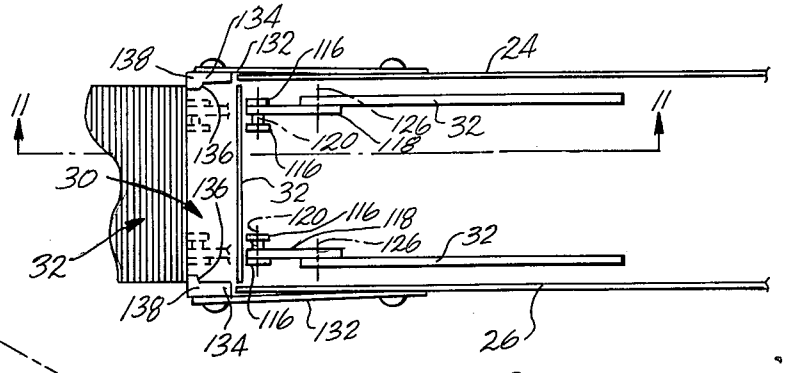
FIG. 12 is a fragmentary, top plan view taken on line 12—12 of FIG. 11.
Figure 11:
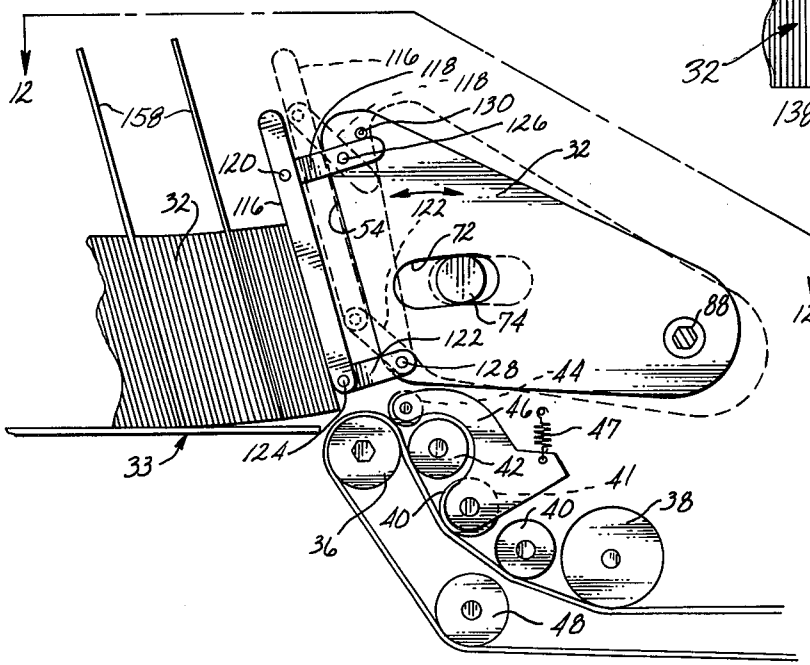
FIG. 11 is a fragmentary, semi-schematic side elevation view, taken on line 11—11 of FIG. 12, illustrating an alternative embodiment of the stacking machine.

An alternative pusher foot arrangement is shown in FIGS. 11 and 12 and described below.

The pusher plates 52 are reciprocally driven in unison toward and away from the stacking area 30 as illustrated by the arrows 70 in FIG. 1. The pusher plates are driven so they reciprocate between the forward positon (shown in solid lines in FIG. 1) and the retracted position (shown in dotted lines in FIG. 1). Each pusher plate has a curved slot 72 and a fixed pin 74 rides in the slot to guide each pusher plate during its reciprocating travel. The pusher plates are reciprocally driven by an eccentric drive mechanism best illustrated in FIGS. 3 and 4. A drive motor, illustrated schematically at 76, is mounted on the base 23 adjacent the inboard stacker guide wall 24. A motor drive gear 78 is rigidly affixed to an output shaft 80 of the drive motor. The drive motor is preferably a shaded-pole 110 volt a.c. drive motor which in one embodiment has an output speed of 240 rpm. The drive motor is adapted to run continuously at the same speed during use of the stacking machine. That is, no clutch mechanisms or other timing or sequencing devices are required for interrupting operation of the motor during use. The motor drive gear 78 is engaged with an idler gear 82 that rotates about a shaft 84 mounted to the inboard stacker guide wall 24. The idler gear 82 is engaged with an eccentric drive gear 86 that rotates an eccentric drive shaft 88. A bearing 89 affixed to the stacker guide wall 24 mounts the eccentric drive gear 86 and the shaft 88. The eccentric drive gear 86 has the same diameter as the motor drive gear 78 so that the 240 rpm output speed of the motor is transferred to the eccentric drive gear and its drive shaft 88 in a 1:1 ratio. A separate drive block 90 is rigidly affixed to the rear end portion of each pusher plate 52. The eccentric drive shaft 88 passes through the inboard stacker guide wall 24, through the drive block 90 of one pusher plate, across the space between the pusher plates and to the drive block on the other pusher plate. The eccentric drive shaft is ridigly affixed to both drive blocks and is eccentrically mounted with respect to the central axis of alignment of the two drive blocks. Thus, the eccentric drive shaft is aligned with the rotational axis 92 of the eccentric drive gear 86 but is offset from the central axis 94 of the two drive blocks 90.

Figure 3:
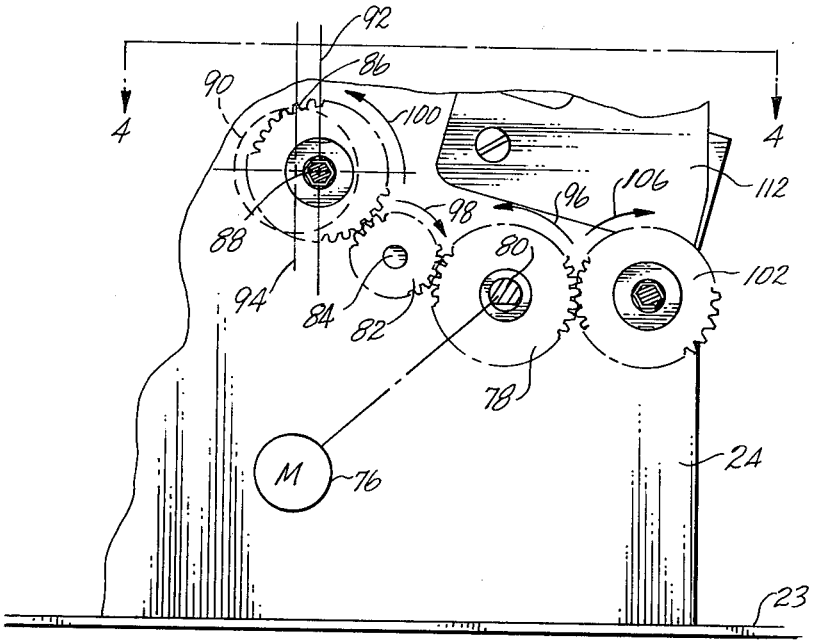
FIG. 3 is a fragmentary, semi-schematic side elevation view illustrating means for powering the stacking machine.
Figure 4:
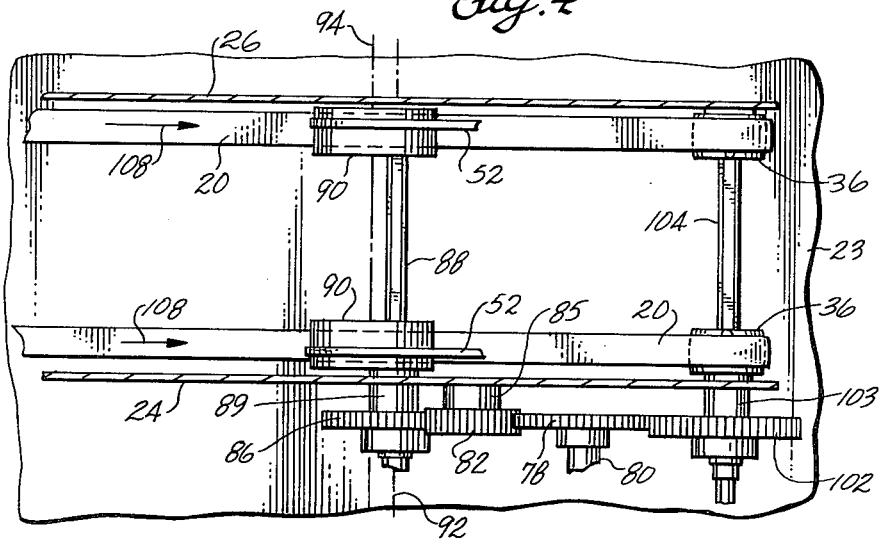
FIG. 4 is a fragmentary, top plan view taken on line 4—4 of FIG. 3.

Operation of the drive motor drives the drive gear 78 in the direction of the arrow 96 in FIG. 3 which, in turn, drives the idler gear 82 in the direction of the arrow 98 to transfer rotation to the eccentric drive gear 86 in the direction of the arrow 100. This causes the drive blocks 90 to rotate about their eccentric axes which, in turn, transfers longitudinally reciprocating motion to the two pusher plates 52.

The drive motor 76 also drives the transport belts 20. A belt drive gear 102 is mounted to a bearing 103 affixed to the inboard stacker guide wall 24 adjacent the stacking area 30. The belt drive gear 102 engages the motor drive gear 78. The diameter of the belt drive gear is the same as the motor drive gear so that the output speed of the motor is transferred to the belt drive gear in a 1:1 ratio. A belt drive shaft 104 is rigidly affixed to the belt drive gear 102. The drive shaft 104 passes through the bearing 103 and the inboard stacker guide wall 24 and through both belt drive rollers 36 at the end of each belt. The belt drive shaft is rigidly affixed to the drive rollers 36 so that rotation of the motor drive gear 78 rotates the belt drive gear 102 in the direction of the arrow 106 in FIG. 3. This rotates the belt drive rollers 36 to move the transport belts 20 in the direction of the arrows 108 shown in FIG. 4.

A pair of gate mechanisms are mounted along opposite sides of the stacking area 30. The gate mechanisms prevent an article that has been pushed forward from moving back toward the pusher mechanism. The gate mechanism can be in various forms. In the embodiment illustrated in FIGS. 1 through 10, the gate mechanism includes a pair of spring loaded article-retaining pads 110 (see FIG. 2) positioned on both sides of the stacking area 30. The article-retaining pads are mounted on separate thin flexible side plates 112 of spring metal affixed to the outside faces of the upright guide walls 24 and 26. The flexible side plates hold the pads in front of the leading edges 54 of the pusher plates as the pusher plates reciprocate toward and away from the stacking area 30. Each pad has a beveled front corner 114 that confronts the pusher plates so that the outer edges of an article pushed toward the pads by the pusher plates will contact the beveled corners of the pads. As shown best in FIG. 2, the pads are spread apart upon engagement with an article being pushed forward by the stacker, owing to the flexibility of the side plates 112. The side plates are spread apart against their normal bias so that the pads can apply a light spring pressure to the edges of the articles being stacked, as described in more detail below.

Figure 5:
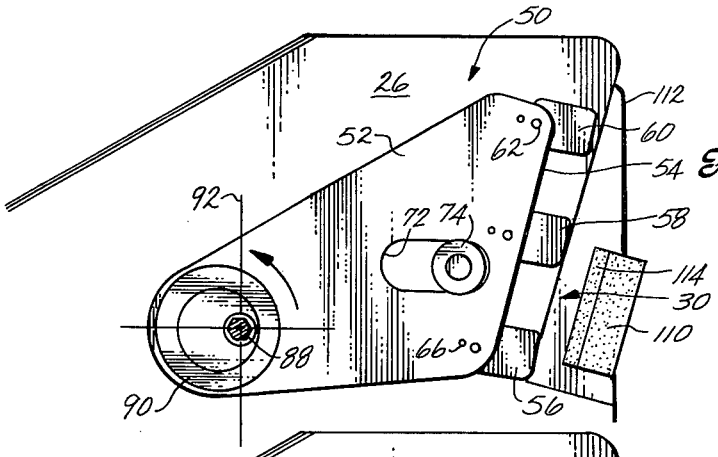
FIGS. 5 through 8 are fragmentary, semi-schematic side elevation views illustrating reciprocating motion of a pusher plate of the stacking machine at 90° intervals of rotation.
Figure 6:
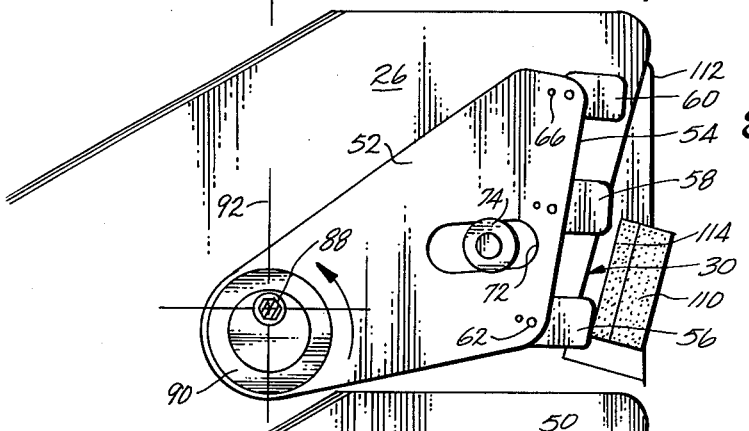
Figure 7:
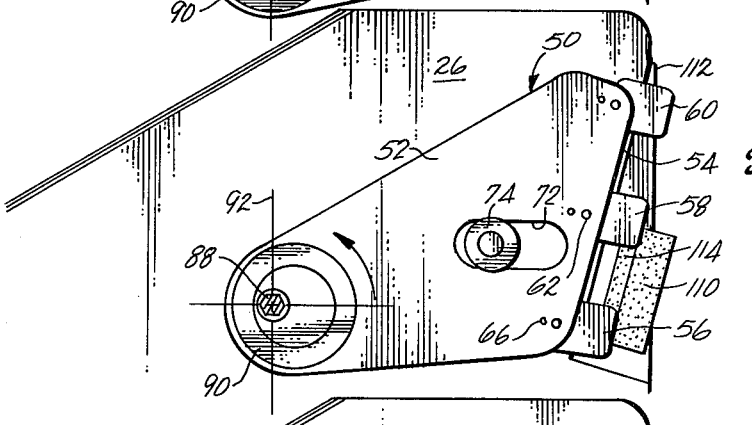
Figure 8:
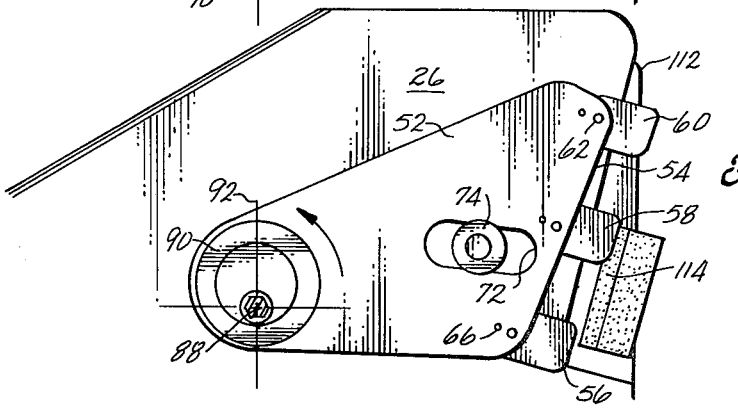

FIGS. 5 through 8 illustrate the cycling of the reciprocating pusher mechanism 50. FIG. 5 illustrates the pusher plates 52 in the retracted position in which the working ends of the pusher feet 56, 58 and 60 are spaced to the rear of the article-retaining 110 pads on opposite sides of the stacking area 30. FIG. 6 illustrates the position of the pusher plates after they have rotated 90° from the retracted position of FIG. 5 toward the stacking area 30. In the position shown in FIG. 6 the pusher feet have moved closer to the spring-loaded pads 110 at opposite sides of the stacking area. FIG. 7 illustrates the position of the pusher plates after they rotated through another 90° arc to the forwardmost position. In moving to this position the working ends of the pusher feet have moved downwardly and outwardly past the plane of the beveled front corners 114 of the spring-loaded pads. FIG. 8 illustrates the position of the pusher plates after they have rotated through a further 90° arc away from the forwardmost position of FIG. 7.

FIGS. 11 and 12 illustrate an improvement to the stacking mechanism. In this embodiment, the pusher foot on each pusher plate comprises a pair of elongated pusher bars 116. Each pair of pusher bars are closely spaced apart and parallel to one another. The pusher bars are pivotally mounted adjacent the working end of each pusher plate. The front end portions of a pair of upper arms 118 are pivotally secured to upper portions of the pusher bars by upper pivot pins 20. The front end portions of a pair of lower arms 122 are pivotally secured to lower portions of the pusher bars by lower pivot pins 124. Rear end portions of the upper arms are pivotally secured to upper portions of the pusher plate by upper pivot pins 126. Rear end portions of the lower arms are pivotally secured to lower portions of the pusher plate by lower pivot pins 128. The pusher bars 116 are shown in their operative positions in solid lines in FIGS. 11 and 12. The bars can rotate upwardly in unison to the inoperative position shown in dotted lines in FIGS. 11 and 12. The pusher bars remain parallel to the working end of the pusher plates as the bars move between the operative and inoperative positions. When an upward pushing force is applied to the bottom arms 122 by an article moving upwardly under a positive force by the transport means, the pusher bars rotate upward from the operative position to the inoperative position. If the upward pushing force on the pusher bars is released, say by releasing the force applied by the transport means, the pusher bars rotate under their own weight back to the operative position. In this instance, each upper arm 118 rotates about the pivot pin 126 until the upper edge of the upper arm engages a separate stop pin 130 which limits further downward rotation of the pusher bars to normally retain the pusher bars in the operative position.

FIG. 12 also illustrates an alternative embodiment of a gate mechanism for preventing stacked articles from backing in and interfering with the next ticket to be stacked. In this embodiment, a pair of flexible spring metal side plates 32 are affixed to the stacker guide walls 24 and 26. The spring metal side plates project along opposite sides of the stacking area 30, and the pusher bars reciprocate inboard from the side plates as shown best in FIG. 12. Separate stack-retaining latches 134 are affixed to the inside faces of the side plates. Each latch has a beveled inside face 136 in front of a tab 138 that projects into the stacking area at the rear end of each latch. The normal lateral distance between the ends of the tabs 138 is less than the width of the articles being stacked. On a forward stroke of the pusher mechanism, the working ends of the pusher bars 116 move forward past the ends of the stack-retaining latches, as best illustrated in the dotted lines in FIG. 12. The side plates spread apart against their normal inward bias as a ticket 32 is pushed past the beveled faces of the latches. The side plates then spring back into their normal position so that the tabs can act as stops to prevent the stacked articles from moving back toward the pusher mechanism.

Prior to using the stacking machine the lateral distance between the transport belts is adjusted to match the width of the articles to be stacked. The outboard stacker guide wall 26 is movable laterally toward or away from the inboard stacker guide wall 24 which, in turn, is rigidly affixed to the base 23. In the illustrated embodiment, the outboard wall is moved until the distance between the transport belts matches the width of the tickets 22, and this setting is best illustrated in FIG. 2 or FIG. 12. The movable wall 26 can be moved along a guide shaft (not shown) extending between the two walls. An adjustment lock (not shown) can be rotated to an open position allowing the outboard wall to be moved manually along the shaft to set the desired spacing between the transport belts. The lock then can be rotated to a closed position preventing further lateral movement of the outboard wall along the shaft. The machine is adapted to stack articles of a fixed width, although the length of the articles can vary and the spacing between them can vary. In the illustrated embodiment the tickets 22 being stacked can be fed from a printing machine in which the tickets are cut from a roll and released horizontally by the printing machine as a continuous series of individual tickets. The stacking machine receives the dispensed tickets and stands the tickets on edge in the stack 32 illustrated in FIG. 1.

Figure 13:
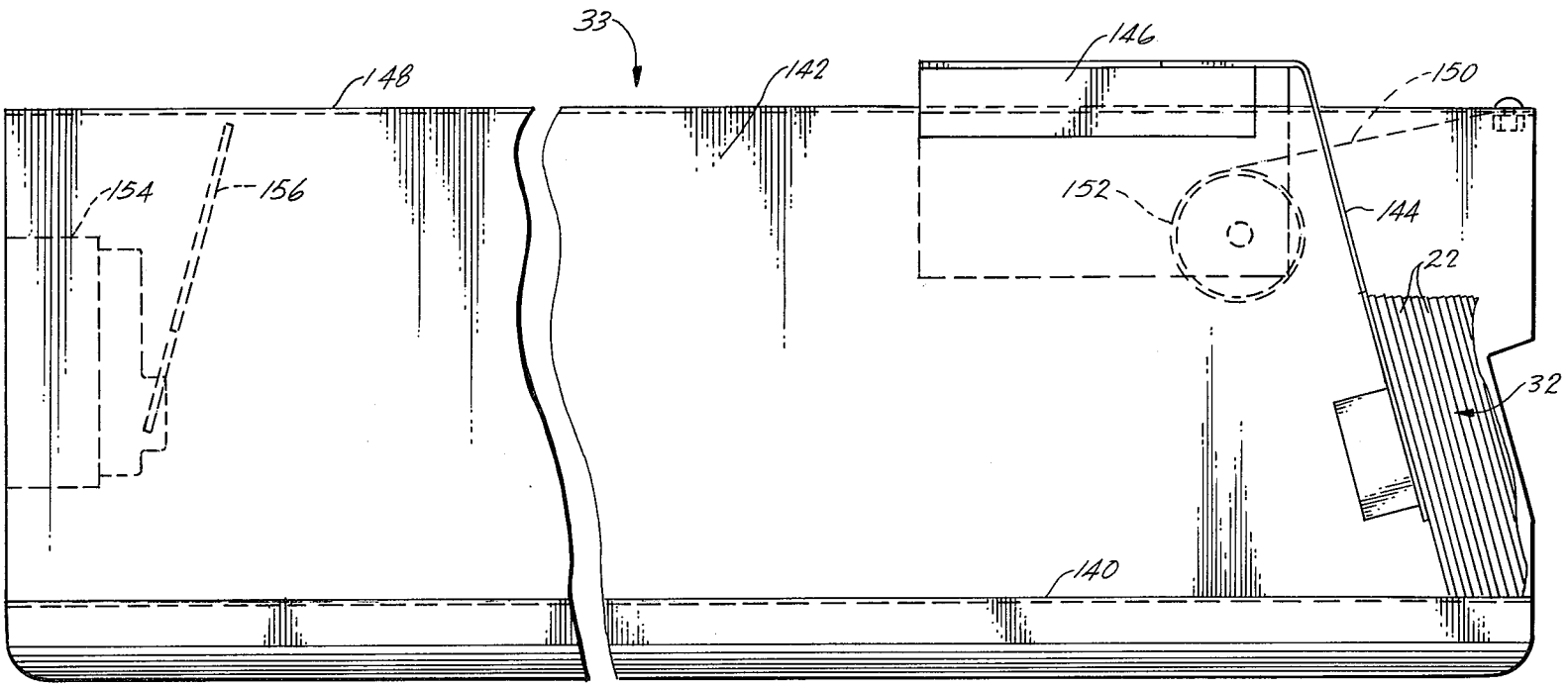
FIG. 13 is a fragmentary side elevation view illustrating a stacker tray for accumulating stacked articles from the stacking machine.

Prior to using the stacking machine the stacker output tray 33 is affixed to a tray support plate (not shown) on the stacking machine adjacent to the stacking area 30. As illustrated best in FIG. 13, the stacker output tray has an elongated flat base 140 and an upright article-retaining wall 142 along one edge of the base. The base of the tray is affixed to the tray support plate which rests at a shallow angle from horizontal, so that the base 140 and the wall 142 of the tray are both retained at slight angles relative to true horizontal and vertical, respectively. These angles allow the weight of the tickets to assist in accumulating the tickets in a stack against the wall 142. The rear of the stack is retained by a movable retainer plate 144 that rides along the length of the tray above the base 140. A channel in a slide block 146 fits over an upper lip 148 of the retaining wall. The movable retainer plate 144 is affixed to the slide block and extends downwardly from the block at a shallow angle from vertical to hold the stack which accumulates from the stacker. The retainer plate and slide block are secured to the rear wall of the tray by a metal strip 150 in the form of a negator spring coiled on a drum 152. The metal strip tends to remain coiled on the drum. As tickets accumulate against the movable retainer plate, the retainer plate travels along the length of the tray (to the left of FIG. 11). The slide block rides along the upper lip 148 and guides movement of the retainer plate. The drum rotates and the metal strip is payed out as the accumulating tickets cause the retainer plate to travel along the length of the tray against the constant spring tension of the negator spring. This urges the retainer plate against the stack with a small amount of spring pressure as the retainer plate moves along the length of the tray. At the opposite end of the tray an electrical switch 154 is affixed to the rear face of the article retaining wall 142. A lever 156 is tripped by contact with the slide block 146 to close the switch 154 when the stack reaches the end of the tray. This switching device can be used to turn off the drive motor or signal that the tray should be emptied.

During use, the tickets that travel along the transport belts are fed into the stacking area by the pinch rollers above the upper run **20*a* of the transport belts. The pusher plates 52 oscillate constantly, and as each upwardly traveling ticket is moved in front of the pusher plates the ticket contacts the pusher feet (or pusher bars) to lift them out of the way (moving them to the inoperative position) while the ticket is still being positively fed into the space in front of the pusher plates. In the embodiment illustrated in FIGS. 1 through 10, the lower pusher feet 68 are first lifted by the upwardly moving tickets. Depending upon the length of the tickets, the intermediate and upper pusher feet also may be lifted away by a ticket being fed upwardly in front of the pusher plates. In the embodiment of FIGS. 11 and 12, the pusher bars are deflected upwardly independently of the length of the articles being stacked. As long as the pinch rolls and the drive belts cooperate to positively feed a ticket upwardly in front of the pusher plates, any contact between the upwardly moving ticket and the pusher feet or bars will deflect the pusher feet or bars upwardly to the inoperative position. In their inoperative position, the pusher feet are freely rotatable in either direction about their pivot pins and are therefore unable to apply any positive forward pushing force to a ticket with which they are in contact. The same is true for the pusher bars. Thus, as long as a ticket is being forced upwardly in front of the pusher plates by the transport rollers, the pusher feet or bars will not be operative to apply a forward pushing force to the ticket. When contact between the deflected pusher feet or bars and the ticket is released, say by a reverse stroke of the pusher mechanism, the weight of the unsupported pusher feet normally rotates them to their operative positions, retained by the stop pins 66 at the back of each foot. The weight of the unsupported pusher bars also rotates the bars downwardly until their upper support arms engage the stop pins 130**. The pusher feet or bars then are retained in the operative position during the next forward stroke of the pusher plates; but if there is any further contact with the upwardly moving ticket on the next forward stroke, the pusher feet or bars are again deflected upwardly to the inoperative position.

Once the upward force on the ticket is released by the pinch rollers, the ticket is then ready to be pushed toward the stack on the next forward stroke of the pusher mechanism. The pusher feet or bars have automatically rotated to their operative positions in the preceding reverse stroke, so that on the next forward stroke the pusher feet or bars will be retained in their operative position to apply a pushing force to the face of the ticket. The pushing force produced on the forward stroke moves the ticket toward the stack.

The upper small pinch roller 44 is as close to the bottom of the stacking area as possible. It is positioned at about the same level as the bottom of the pusher bars 116, and the roller is also at approximately the same level as the tray 33 on which the stacked tickets accumulate. Thus, the upper pinch roller is able to apply a positive drive to tickets of all lengths until the entire ticket has been moved into the stacking position.

In the embodiment of FIGS. 1 through 10, the edges of the forward-moving ticket contact the spring-loaded pads 110 on opposite sides of the stacking area. As the pusher plates move forward, the working ends of the pusher feet push the ticket beyond the plane of the beveled portions of the pads. The friction produced by contact between the outer edges of the ticket and the beveled portions of the pads, together with the spring pressure applied by the side plates 112 retain the ticket between the pads as the pusher feet are then retracted on the next return stroke of the pusher mechanism.

In the embodiment of FIGS. 11 and 12, the pusher bars push the tickets past the ends of the tabs 138 on the spring-loaded latches 134. The spring-loaded latches spring back and act as a positive stop to prevent the tickets that have been pushed forward onto the stack from backing up and blocking or interfering with the next ticket fed to the pusher plates. This also avoids the next incoming ticket from lifting the stack of tickets.

Since the pusher feet do not push a ticket onto the stack until the ticket is released by the pinch rollers, the stacker can continuously stack articles of varying lengths. Regardless of changes in the length of the tickets being stacked, the pusher feet will always remain inoperative until the ticket is released by the transport mechanism (the pinch rollers). Thus, as illustrated best in FIG. 1, the ticket stacker can stack the standard sized tickets 22, as well as the longer flag cards 158 which can be stacked at random intervals for separating the standard sized tickets into groups.

Figure 9:
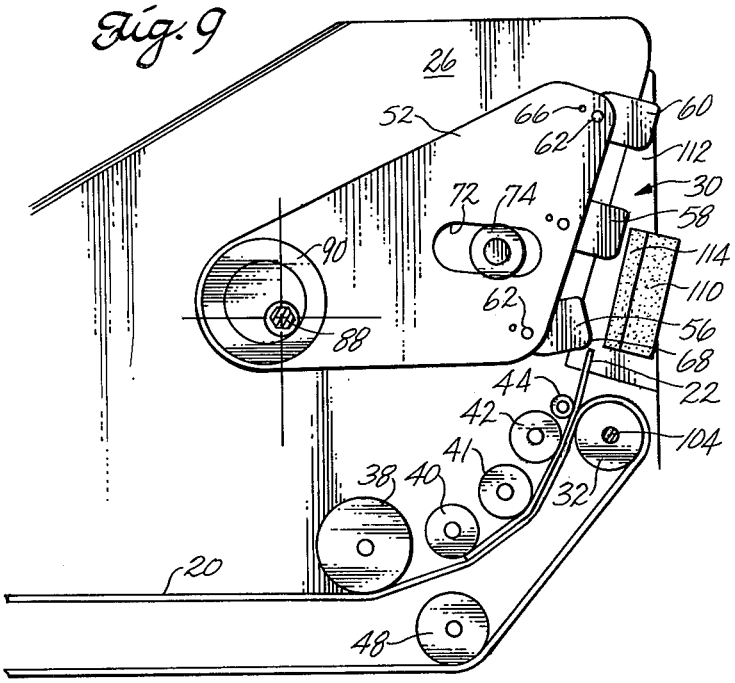
FIG. 9 is a fragmentary, semi-schematic side elevation view illustrating contact between an article and a movable pusher foot on the pusher plate when the pusher plate is in a rear portion of its stroke.
Figure 10:
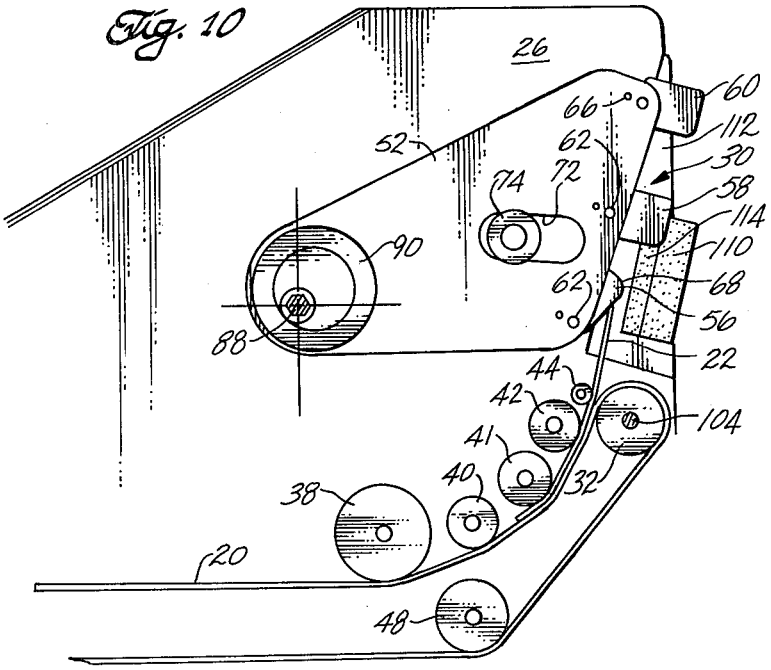
FIG. 10 is a fragmentary, semi-schematic side elevation view illustrating contact between an article and a movable pusher foot on the pusher plate when the pusher plate is in a forward portion of its stroke.

As explained above, the pusher plates will move a ticket into position for stacking independently of the length of the ticket or the spacing between tickets. FIGS. 9 and 10 illustrate this principle by showing that a ticket can be moved into position for stacking regardless of its position relative to the cycling motion of the pusher plates. That is, as long as the pinch rollers continue to grip a ticket and apply a force to the ticket to move it upwardly into position for stacking, the pusher feet or bars will remain inoperative; and this allows a ticket located at any position on the transport track to move into position in front of the plates independently of the continuous, constant speed cycling motion of the pusher plates. For instance, FIG. 9 shows the pusher plates in a somewhat retracted position during the reciprocating cycle. While the pusher plates are in such a retracted position, a ticket is being moved upwardly into the stacking position by the pinch rollers; and the upper edge of the ticket is deflecting the lower pusher feet into their inoperative positions. The pusher plates will continue to cycle until the ticket finally is released, after which the pusher feet, in their operative positions, will push the ticket forward onto the stack during the next forward cycle.

FIG. 10 shows the pusher plates in a somewhat forward portion of the cycle, while a ticket being pushed upwardly is located at about the same place on the transport track as the ticket shown in FIG. 9. With the pusher plate in the forward position the upper edge of the ticket is deflecting the lower pusher feet into their inoperative positions; and again the pusher plates will continue to cycle until the ticket is finally released, after which the pusher feet will return to their operative positions and then push the released ticket forward onto the stack during the next forward stroke.

In summary, the stacking machine accepts and stacks tickets as they are cut from a roll and released by a printing machine. The stacker can accept and stack continuously varying lengths of tickets, i.e, the print machine can vary the feed length of the ticket at any time and the stacker can stack it with no manual adjustment. This is accomplished by the continuously oscillating pusher mechanism that pushes the tickets into the stack after the tickets have left the transport mechanism. The pusher mechanism has pusher feet in the form of individual feet or long bars that are rotated upwardly by a ticket leaving the transport rollers, and this action makes the pusher mechanism unfunctional while the ticket is moving into position. Once the ticket is in position and released by the transport rollers, the pusher feet or bars can drop down on a return stroke and push the ticket onto the top of the stack during the next forward stroke. The pusher area of the stack is kept open for entering tickets by a gate mechanism which either grips the sides of the previously stacked tickets or opens to let them pass and then blocks their re-entry into the stacking area. The invention works best with the gate mechanism of FIGS. 11 and 12. It does not rely on squeezing the tickets that have been pushed onto the stack, which can be unreliable in always applying the required spring force to prevent tickets from backing into the stacking area. Tickets of short length also can buckle and cause the next ticket to snag with a gate mechanism that relies on squeezing the tickets. The retaining latches 134 avoid these problems by applying a positive stop to the front face of each ticket that has been stacked to cause the tickets to lie flat and to block their re-entry into the stacking area. The invention also works best with the elongated pusher bars 116 of FIGS. 11 and 12. The pusher bars are sufficiently long that they contact essentially the entire length of each ticket, independently of the length of each ticket. This ensures that all tickets, independent of their length, are pushed squarely past the retaining latches 134, which also assists in preventing stacked tickets from buckling, bending or otherwise interfering with a continuous high speed stacking operation.

What is claimed is:

1. Article stacking apparatus, comprising:

a pusher plate;

a movable pusher foot carried on a working end of the pusher plate;

means for reciprocating the pusher plate in forward and reverse directions toward and away from a stacking area adjacent the pusher foot;

transport means for feeding articles to a stacking position in the stacking area and for releasing the articles once they reach the stacking position, the pusher foot being movable relative to the pusher plate between (1) an operative position in which the pusher foot can apply a positive pushing force to an article released to the stacking position as the pusher plate moves the pusher foot in the forward direction for moving the article forward onto a stack, and (2) an inoperative position to which the pusher foot can move in response to contact with an article being fed into the stacking position, so that a pushing force is not applied to the article by the inoperative pusher foot as long as the article is still being fed into the stacking position; and gate means past which the pusher foot, in its operative position, is moved during the forward travel of the pusher plate for applying a positive stop against the front face of each article moved onto the stack.

2. Apparatus according to claim 1 in which the pusher foot is free to pivot to the inoperative position under the force of an article moving into contact with it by the force applied to the article by the transport means, and in which the pusher foot is free to move under its own weight into the operative position when such contact with the article is released.

3. Apparatus according to claim 2 including at least one pivot pin about which the pusher foot freely rotates, and a stop pin into contact with which the pusher foot rotates under its own weight, the stop pin releasably retaining the pusher foot in the operative position.

4. Apparatus according to claim 1 in which the gate means comprise spring-biased latches on opposite sides of the pusher plate for spreading apart under contact with opposite sides of an article pushed forward during the forward stroke of the pusher plate and for returning under spring tension to a position for preventing the article from moving back toward the pusher plate during a subsequent return stroke.

5. Apparatus according to claim 1 in which the transport means include a transport belt and drive means for continuously moving the transport belt to the stacking area at a constant speed.

6. Apparatus according to claim 5 in which the drive means continuously reciprocates the pusher plate during continuous travel of the transport belt.

7. Apparatus according to claim 1 in which the pusher foot comprises at least one elongated continuous pusher bar extending along the working end of the pusher plate, and means pivotally securing the pusher bar to the pusher plate so that the bar is normally retained in an outwardly projecting operative position but is freely movable to the inoperative position.

8. Apparatus according to claim 7 including a pair of said pusher plates spaced apart laterally on opposite sides of the transport means; and at least one of said pusher bars on each pusher plate for applying a pushing force to opposite sides of the article.

9. Apparatus according to claim 8 in which the gate means comprise spring-biased latches adjacent the pusher plates for spreading apart under contact with opposite sides of an article pushed forward during the forward stroke of the pusher plates and for returning, under spring tension, to a position for preventing the article from moving back toward the pusher plates during a subsequent return stroke.

10. Apparatus according to claim 1 in which the transport means includes a moving transport belt and one or more pinch rollers for moving the article traveling on the belt into the stacking position under a positive force.

11. Apparatus according to claim 10 in which the pinch roller is spring-biased against the transport belt.

12. Apparatus according to claim 11 in which the spring-biased pinch roller is essentially at the level of the bottom of the pusher foot.

* * * * *